US006674352B2

(12) United States Patent
Montuschi et al.

(10) Patent No.: US 6,674,352 B2
(45) Date of Patent: Jan. 6, 2004

(54) MOVING-COIL ELECTROMAGNETIC ACTUATOR, PARTICULARLY FOR A CONTROL VALVE, WITH RESILIENT ELEMENT INCORPORATED IN THE COIL

(75) Inventors: Mario Montuschi, Turin (IT); Eugenio Faggioli, Turin (IT)

(73) Assignee: C.R.F. Societa Consortile per Azioni, Turin (IT)

( * ) Notice: Subject to any disclaimer, the term of this patent is extended or adjusted under 35 U.S.C. 154(b) by 250 days.

(21) Appl. No.: 09/893,689

(22) Filed: Jun. 29, 2001

(65) Prior Publication Data

US 2002/0050897 A1 May 2, 2002

(30) Foreign Application Priority Data

Jun. 30, 2000 (IT) ..... TO2000A0654

(51) Int. Cl.[7] ..... H01F 7/13; H01F 5/00
(52) U.S. Cl. ..... 335/274; 335/282; 335/299
(58) Field of Search ..... 335/274, 282, 335/299, 222, 223

(56) References Cited

FOREIGN PATENT DOCUMENTS

| | | |
|---|---|---|
| DE | 31 17 192 A1 | 11/1982 |
| GB | 2 067 661 A | 7/1981 |

*Primary Examiner*—Ramon M. Barrera
(74) *Attorney, Agent, or Firm*—Sughrue Mion, PLLC

(57) ABSTRACT

An electromagnetic actuator, particularly for a valve for controlling the injection of fuel or fuel oil is described and comprises:

a fixed permanent magnetic core, and an electrical control winding which is disposed in the magnetic field generated by the core and is movable relative to the core when an electrical current flows through the winding, in which the winding is intended to be connected to a movable member actuable by the device, in a manner such as to bring about movement of the movable member between a rest position and at least one operative position.

The winding is also arranged to act on the movable member by exerting a resilient force which can hold the member in the rest position or return the member to the rest position.

12 Claims, 2 Drawing Sheets

MOVING-COIL ELECTROMAGNETIC ACTUATOR, PARTICULARLY FOR A CONTROL VALVE, WITH RESILIENT ELEMENT INCORPORATED IN THE COIL

FIELD OF THE INVENTION

The present invention relates to a moving-coil electromagnetic actuator and, in particular, to an actuator for a valve for controlling the injection of fuel or fuel oil.

BACKGROUND OF THE INVENTION

In the field of fuel-injection control valves, there are known actuators of the electromagnetic type which comprise a fixed electrical winding (coil) fixed firmly to the valve body. In such an actuator, a movable armature of ferromagnetic material having one end connected to a closure member of the valve is arranged coaxially with the winding and can slide (inside the winding) under the effect of the electromagnetic field generated by the winding when an electric current flows through it, bringing about opening and closure of the valve. A biasing spring is provided for bringing the armature to a rest position in the absence of electromagnetic operation, for example, to reach a valve-closure position.

The main problem with known devices is that they cannot be operated very rapidly because of the high inertia of the components.

The energy required to bring about the movement of the armature, and hence the travel of the closure member connected thereto, is directly proportional to the masses of the moving components and to the desired speed of execution of the operation. The mass of the movable armature of ferromagnetic material cannot be reduced beyond a particular limit because it is responsible for the force produced, and the mass of the biasing spring also partially determines the inertia which the electromagnetic operation has to overcome.

In order to generate the magnetic field necessary to bring about a rapid movement of the armature within a short time, it is therefore necessary to force a current of high intensity into the winding, to overcome the overall inertia of the moving parts, the pressure of the spring, and possibly that of the fuel or fuel oil; this requires a correspondingly high voltage, which is normally greater than the battery voltage available in motor vehicles.

The fixed valve core and the movable armature, both of which are made of ferromagnetic material, are thus subject to strong parasitic currents generated by magnetic induction and therefore (at least for the fixed core) have to be made of sintered material to limit this effect as far as possible, further increasing the costs and size of the device.

In these conditions, the inductance of the coil is normally high and the reactive component absorbs and stores a further quantity of energy proportional to the square of the intensity of the current flowing through it.

The rapid actuation times of the device which can be achieved by optimizing all of the parameters do not, however, permit multiple precise injections in close succession.

There may be further disadvantages owing to the range of temperature variation to which the device is subject in operation, which is due both to the large currents passing through it, and to the temperature of the engine environment.

Also known in the art are moving-coil electromagnetic actuator devices of the type comprising a magnetic core fixed to the body of the device and an electrical winding (a coil) immersed in the magnetic field produced by the core and movable relative to the core.

When an electric current flows through the winding, the winding translates rigidly, at a speed proportional to the magnetic induction, to the length of the wire constituting the winding, and to the current intensity. It is connected mechanically to a member to be actuated, so as to transfer thereto every stress (travel) to which it is subjected. A resilient reaction element is connected to the winding and to the member actuated thereby and is arranged to bring both of them to a rest position in the absence of an activation control.

As in the previous case, the mass of the resilient reaction element affects the efficiency of the device in terms of speed and energy, limiting its response rate upon activation. A fixing system is also required and this further complicates the device and makes it heavier.

A further aspect which affects the complexity of the device and its cost relates to the electrical connections which connect the winding to a fixed electrical driver circuit, and which have to be movable relative to the driver circuit in order to follow the travel of the winding.

SUMMARY OF THE INVENTION

The aim of the present invention is to provide a satisfactory solution to the problems set out above, overcoming the disadvantages of the prior art.

According to the present invention, this aim is achieved by means of an actuator device, particularly for a control valve, having the characteristics recited in claim 1.

In summary, the present invention is based on the principle of forming the resilient reaction element, in a moving-coil electromagnetic actuator, by means of the electrical winding itself, by taking advantage, in particular, of the helical configuration which is common to both and thus reducing the weight of the movable portion of the device so as to permit a fast response rate of the system, even with low operating currents.

The resilient element and the helical moving coil which are combined in a single member hereinafter defined as a whole as the actuating member of the actuator device, have a first, fixed end portion, fixed firmly to the body of the device and a second end portion which is movable away from or towards the fixed portion and is mechanically connected to the member to be controlled (for example, the closure member of a control valve).

According to the currently-preferred embodiment, the actuating member is formed in a two-layered helical configuration (that is, as a double winding), both ends of which are disposed in the region of the fixed portion of the actuating member thus formed, and are connected to respective electrical connection terminals that are also fixed.

An outwardly-extending helical section constituting a first layer extending from a first connection terminal as far as the movable end portion, and a return helical section constituting a second layer, arranged coaxially in series with the previous section, preferably wound outside it, and extending, still with the same direction of winding, from the movable end portion to the second connection terminal, are defined relative to the above-mentioned terminals.

The electrical winding is immersed in a strong fixed magnetic field generated by a permanent magnet.

Since the electrical winding also has to perform the function of a resilient element, it is no longer subjected to a rigid translational movement, but to an extension and contraction movement, in which the fixed end portion constitutes the reference relative to which this movement is performed.

The solution described thus advantageously solves the problem of the prior art devices since, as indicated, the configuration adopted enables both of the electrical connection terminals to be extracted in the region of the same end portion of the actuating member and also enables the terminals to be fixed

BRIEF DESCRIPTION OF THE DRAWINGS

Further characteristics and advantages of the invention will be explained more fully in the following detailed description of an embodiment thereof, given by way of non-limiting example, with reference to the appended drawings, in which.

DETAILED DESCRIPTION OF THE PREFERRED EMBODIMENT

Figure 1:
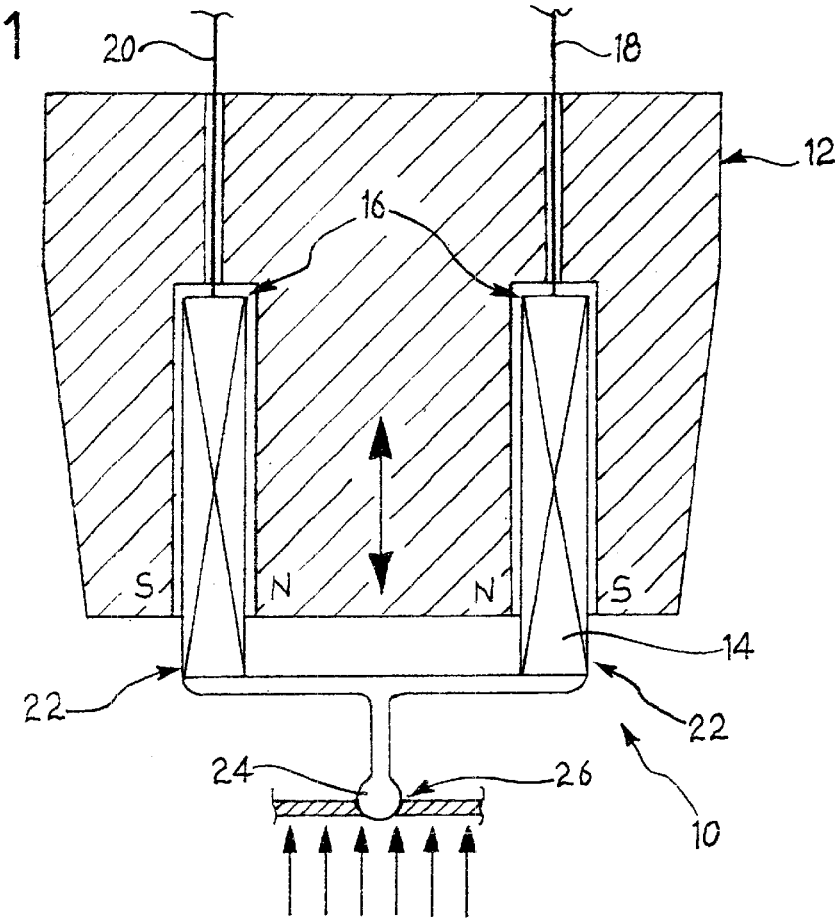
FIG. 1 is a view showing an actuator device according to the invention, in section.

An electromagnetic actuator device according to the invention is shown schematically and indicated 10 in FIG. 1. In this example, a possible application to a valve for controlling the injection of fuel or fuel oil is described, but this possible use, which is adopted herein for simplicity of discussion, should be understood as purely indicative.

The actuator device 10 comprises a fixed magnetic core 12 (a permanent magnet) having concentric north and south pole extensions and formed as a unitary, sintered element of a shape suitable for ensuring uniformity of the magnetic induction vector in the air-gap, and of a material with a high coercive force.

A helical electrical winding 14 (hereinafter referred to more briefly as the coil) is disposed on the core 12 in a concentric position between the pole extensions and is immersed in the magnetic field generated by the core 12.

A first end portion 16 of the coil is fixed relative to the core. Two ends of the winding are extracted therefrom to form a pair of connection terminals 18, 20 for connection to an electrical driver circuit (not shown in FIG. 1).

The opposite end portion 22 is free and is mechanically coupled to a valve-closure member 24 which cooperates with a corresponding seat 26. The coupling may take place by means of an element made of light, strong material, possibly a non-metallic material (for example, carbon, titanium, etc.) and the closure member is conventional. A guide element made of light material may advantageously be associated with this end to facilitate its linear travel and to promote precise coupling between the closure member and its seat.

Owing to the nature of its mechanical connection to the magnetic core 12, the coil 14 behaves substantially as a helical torsion spring and constitutes the actuating member of the actuator device, combining the functions of the electromagnetically-operated control member and of the resilient reaction element.

Figure 2:
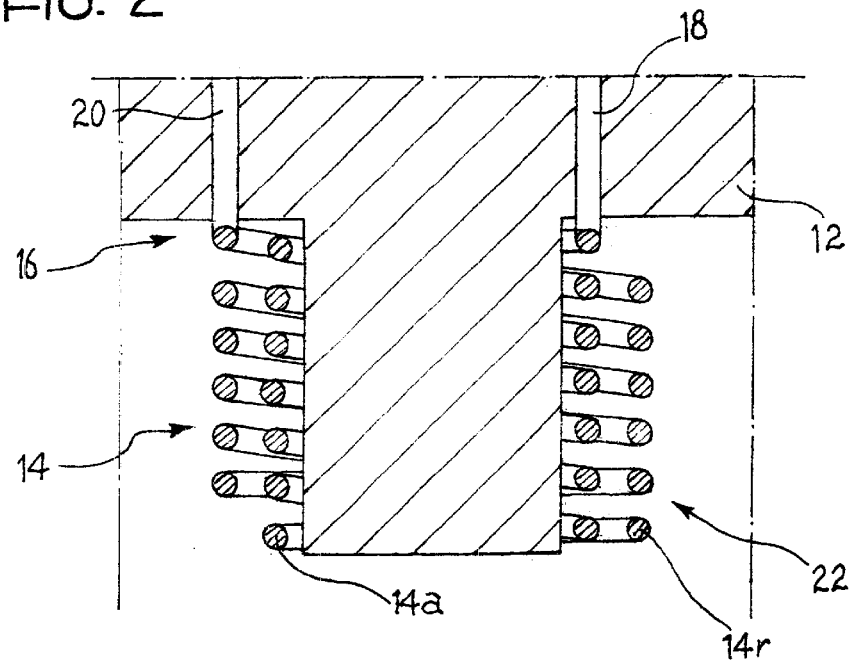
FIG. 2 shows a detail of the device of FIG. 1, on an enlarged scale.

In FIG. 2, the coil 14 is shown schematically in enlarged section in order to show better its particular construction with a two-layered, that is, double-winding, helical configuration.

If the path of the electric activation current along the winding is considered, starting from a first, input connection terminal 18, the coil 14 has an outwardly-extending helical section 14*a* which extends from the fixed end portion 16 as far as the movable end portion 22, and a return helical section 14*r* in series with the previous section, wound coaxially outside it, and extending, still with the same direction of winding, from the movable end portion 22 to the fixed end portion 16. The return helical section 14*r* terminates in a second connection terminal 20.

The coil may advantageously be made of a material having good electrical conductivity and good resilience characteristics, for example, bronze with a high elastic constant and low electrical resistivity.

The coil is formed in a manner such as to be normally spring-loaded, as a spring in compression, in a rest position of the device, so as to oppose the fluid pressure (indicated by the series of arrows of FIG. 1) on the closure member and to ensure tightness of the valve in a closure position thereof.

The free end portion 22 of the coil 14 may be connected to the closure member 24 by gluing or simply by bearing thereon with slight engagement, the latter solution preferably being usable when the axial movements of the coil are guided.

Since the coil is immersed in a magnetic field, each of its turns can move towards or away from the fixed reference portion 16, in dependence on the intensity and direction of the current flowing through the winding, according to the well-known Laplace's law. This involves an overall behaviour of the coil as a whole which is comparable to an extension or contraction movement of a resilient spring subjected to tensile and compression forces, and is indicated by the double arrow in FIG. 1.

When the device is in operation, an open position of the valve can be reached simply by causing a current to flow in the coil in a direction such that, according to Laplace's law, each individual turn is attracted towards the fixed portion 16 of the winding, bringing about a contraction of the entire actuating member and the removal of the closure member 24 from the seat 26.

The control may be a low-voltage control since the inductance of the coil is low, there is no metal component to be magnetized, and the inertia of the movable masses is also low. It suffices to overcome the back electromotive force in the coil, which is of the order of a few volts, at the desired high speed.

The closure position of the valve can be reached simply by utilizing the resilient returning force of the actuating member, or by reversing the electrical control to the coil, that is, the direction of flow of the current.

A device according to the invention advantageously achieves fast opening and/or closure speeds of the valve within times of the order of 100 $\mu$s, or even less. When used for valves for controlling the injection of fuel or Diesel fuel, the device enables pre-injections and multiple injections to be performed and enables the opening of the valve to be modulated, even with partially-open positions.

The activation energy required is low in comparison with similar devices described with reference to the prior art since, not only is the overall mass of the movable components reduced, but the losses typical of a device with a movable ferromagnetic armature and a fixed ferromagnetic portion also no longer arise.

The electrical control is reversible and requires a low energy supply; for example, the driving voltage supplied by a conventional motor-vehicle battery is sufficient.

Figure 3:
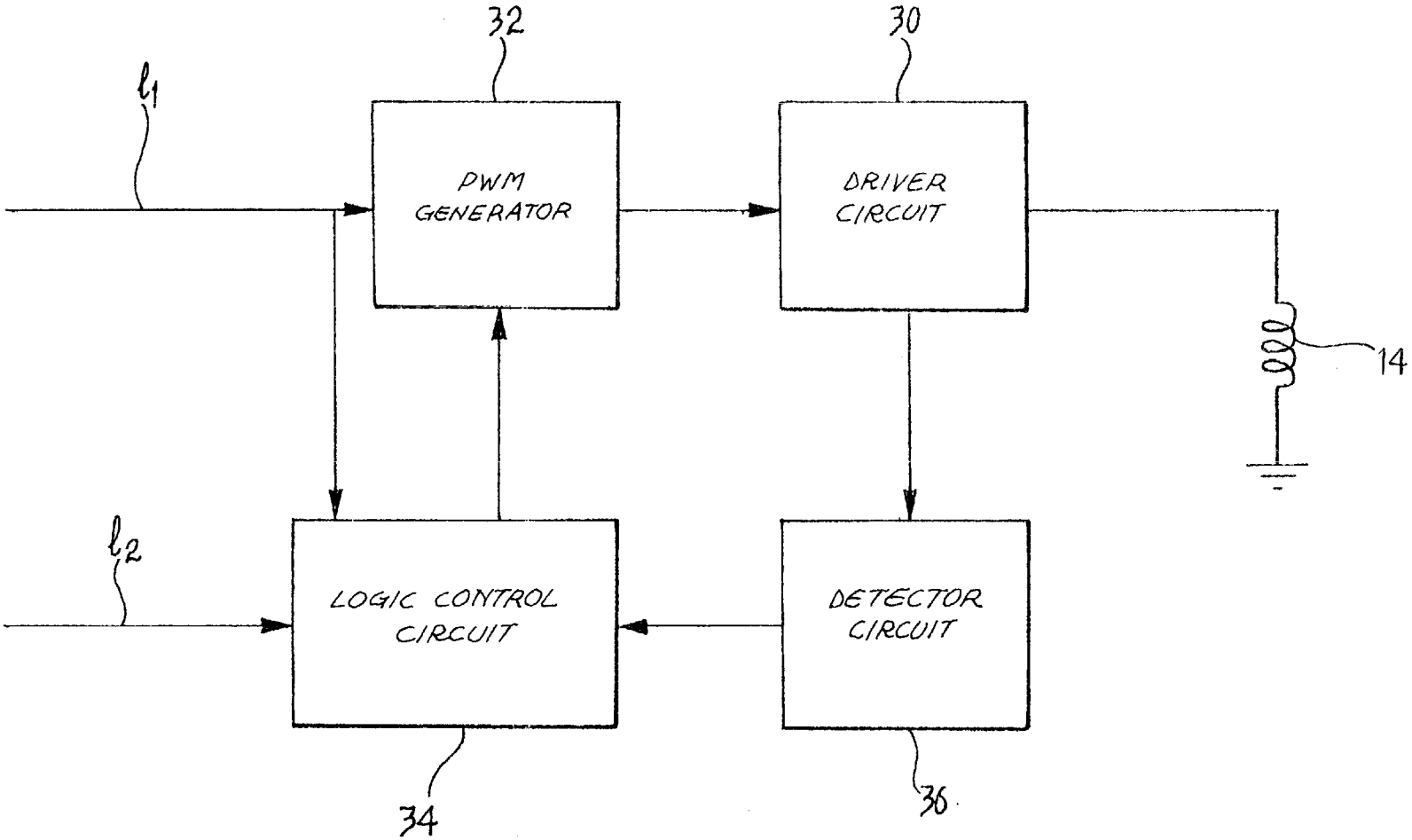
FIG. 3 is a block circuit diagram of a control circuit for the device according to the invention.

FIG. 3 is a functional block diagram of a preferred control circuit. The coil 14 is supplied in a reversible manner by means of a driver circuit 30 controlled, at a control input, by a circuit 32 for generating pulse-width modulated current signals, in turn supplied by a motor-vehicle battery (not shown), via a supply connection $l_1$.

A control input of the generator circuit 32 is connected to a control logic circuit 34 which receives, at a first input, an injection-control signal (via the connection $l_2$) and, at a second input, a regulation signal produced by a detector circuit 36.

The detector circuit 36 is connected to the driver circuit 30 and is arranged to detect an open, partially open, or closed condition of the valve, in dependence on the back electromotive force present in the coil 14 due to its movement.

According to the solution described with reference to the preferred application, the electronic control circuit is integrated with the power circuit for actuating the injection valve, in the valve itself. The length of the electrical connections, particularly of the high-current connections, is advantageously reduced and, in the event of breakdown of one of the circuits, it is possible to replace only the respective injection valve.

Naturally, the principle of the invention remaining the same, the embodiments and details of construction may be varied widely with respect to those described and illustrated purely by way of non-limiting example, without thereby departing from the scope of protection of the present invention defined by the appended claims.

What is claimed is:

1. An electromagnetic actuator device, particularly for a valve for controlling the injection of fuel or fuel oil, comprising:

a fixed permanent magnetic core, and an electrical control winding which is disposed in the magnetic field generated by the core and is movable relative to the core when an electrical current flows through the winding, in which the winding is coupled to a movable member actuable by the device, in a manner such as to bring about movement of the movable member between a rest position and at least one operative position, wherein the winding is arranged to act on the movable member by exerting a resilient force which can hold the member in the rest position or return the member to the rest position, in the absence of electrical current and wherein the winding has a plurality of coaxial turns arranged to form a helical configuration having a first, fixed end portion and a second, free end portion coupled to the movable member, the turns being able to move apart or towards one another in dependence on the direction of flow of the current so as to move the free end portion away from or towards the fixed portion, bringing about an overall resilient deformation of the winding.

2. A device according to claim 1, wherein the winding is formed in a two-layered helical configuration in which a first section extends from a first end of the winding to the free end portion, forming a first layer, and a second section coaxial with the first section extends from the free end portion to the second end of the winding, forming a second layer.

3. A device according to claim 2, wherein the second section is wound with the same direction of winding as the first section and outside the first section.

4. A device according to claim 2, wherein the ends of the winding are connected to respective fixed connection terminals in the region of the first end portion.

5. A device according to claim 1, wherein the winding is stressed in compression when the movable member is in the rest position.

6. A device according to claim 5, wherein, when a current flows through the winding in a first direction, the winding undergoes a contraction and acts in tension on the movable member, causing it to move away from the rest position.

7. A device according to claim 6, wherein, when a current flows through the winding in a second direction, the winding undergoes an elongation and exerts a thrust on the movable member promoting its return to the rest position.

8. A device according to claim 1, which comprises means for guiding the movement of the winding axially.

9. A device according to claim 1, wherein the winding is coupled to the movable member by gluing or similar adhesive joining.

10. A device according to claim 1, wherein the winding is coupled to the movable member by contact.

11. A device according to claim 1, which comprises a circuit for controlling the intensity and the direction of the current which flows through the winding, the circuit being integrated in the device and being able to bring about reversal of the current in order to reverse the direction of movement of the winding.

12. A device according to claim wherein the control circuit comprises a circuit for detecting the position of the movable member, which circuit can detect the back electromotive force present in the winding and due to its movement.

* * * * *